US006901691B1

(12) United States Patent
Little

(10) Patent No.: US 6,901,691 B1
(45) Date of Patent: Jun. 7, 2005

(54) MINIMUM EXPOSURE WEAPON

(76) Inventor: Ronald B. Little, 181 Hickory Ridge Rd., Florence, MS (US) 39073

( * ) Notice: Subject to any disclaimer, the term of this patent is extended or adjusted under 35 U.S.C. 154(b) by 3 days.

(21) Appl. No.: 10/724,929

(22) Filed: Dec. 1, 2003

(51) Int. Cl.[7] ..... F41G 1/40

(52) U.S. Cl. ..... 42/118; 42/72; 42/74.73; 42/75.03; 42/75.04

(58) Field of Search ..... 42/118, 71, 72, 42/73, 75.03, 71.01, 94

(56) References Cited

U.S. PATENT DOCUMENTS

| | | | | | |
|---|---|---|---|---|---|
| 694,904 | A | * | 3/1902 | Youlten | 42/118 |
| 1,176,893 | A | * | 3/1916 | Hartney | 356/254 |
| 1,222,778 | A | * | 4/1917 | McCleary | 42/73 |
| 1,386,247 | A | | 8/1921 | Forduce | |
| 2,386,802 | A | * | 10/1945 | Johnson, Jr. | 42/94 |
| 2,771,697 | A | | 11/1956 | Reising | |
| 2,826,848 | A | | 3/1958 | Davies | |
| 3,262,440 | A | * | 7/1966 | Kuhn | 124/67 |
| 3,369,316 | A | | 2/1968 | Miller | |
| 3,442,042 | A | * | 5/1969 | Gilbert | 42/73 |
| 3,863,354 | A | * | 2/1975 | Karppinen | 42/118 |
| 4,677,781 | A | | 7/1987 | Lee | |
| 4,827,652 | A | | 5/1989 | Martin | |
| 4,878,305 | A | | 11/1989 | Gabrielidis | |
| D324,557 | S | | 3/1992 | Livingston | |
| 5,675,112 | A | | 10/1997 | Giry | |
| 6,070,355 | A | | 6/2000 | Day | |
| 6,397,507 | B1 | | 6/2002 | Marshall | |
| 6,517,133 | B2 | | 2/2003 | Seegmiller | |
| 6,526,683 | B1 | * | 3/2003 | Crandall | 42/40 |
| 6,543,173 | B1 | * | 4/2003 | Golan | 42/75.04 |
| 6,591,533 | B2 | * | 7/2003 | Wygant | 42/72 |
| 6,598,329 | B1 | * | 7/2003 | Alexander | 42/71.01 |
| 6,637,141 | B1 | | 10/2003 | Weatherby | |
| 6,662,485 | B2 | * | 12/2003 | Kay | 42/75.03 |
| 2003/0101631 | A1 | * | 6/2003 | Fitzpatrick et al. | |
| 2004/0144010 | A1 | * | 7/2004 | Golan | |

FOREIGN PATENT DOCUMENTS

| | | | | |
|---|---|---|---|---|
| FR | 2571864 A2 | * | 4/1986 | F41G/7/30 |
| FR | 2581745 A1 | * | 11/1986 | F41A/3/72 |

OTHER PUBLICATIONS

"New US Rifle Can Shoot Around Corners" Ian Brodie, Feb. 27, 2000, available @ http://www.rense.com/ufo6/corner.htm.*

* cited by examiner

*Primary Examiner*—Micheal Carone
*Assistant Examiner*—Daniel Lawson Greene, Jr.

(57) ABSTRACT

A proven military combat-type weapon with the stock removed therefrom converted to an improved tactical weapon by addition of retrofit assemblies which include a collapsible and bilaterally pivoting stock, a front stabilization system, and a sighting system. This improved tactical weapon has the characteristics of reduced exposure to enemy fire by allowing the operator to fire while under cover, and increased weapon stability by the utilization of the front stabilizer assembly. Utilizing this invention, the operator is able to shoulder support and fire the weapon with minimal exposure to enemy fire. Furthermore, by exerting force to (leaning against) the weapon stock, the weapon is pinned between the operator and the object (i.e., wall, tree, etc.). The amount of gun movement is reduced and the stability of the weapon is increased over a weapon which is only hand held when the gun is fired.

17 Claims, 12 Drawing Sheets

MINIMUM EXPOSURE WEAPON

BACKGROUND OF THE INVENTION

1. Field of the Invention

The present invention relates to firearms and, more particularly, pertains to a minimum exposure weapon which allows the user to stabilize and fire the weapon from a covered position with minimal exposure to enemy fire.

2. Description of Prior Art

The use of firearms is known in the prior art. More specifically, firearms heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. Des. 324,557; 6,637,141 B1; 6,598,329 B1; 6,517,133 B2; 6,397,507 B1; 6,070,355; 5,675,112; 4,878,305; 4,827,652; 4,677,781; 3,369,316; 2,826,848; 2,771,697; and 1,386,247.

The inventive device substantially departs from the conventional concepts and designs of the prior art and in doing so provides a weapon primarily developed for the purpose of allowing a user to support the weapon in the conventional stance (utilizing both hands and a shoulder to brace the weapon) while having a minimal exposure to enemy fire.

In view of the foregoing disadvantages inherent in the known types of firearms now present in the prior art, the present invention provides for increased weapon stability while allowing the user to fire from behind structures with a minimum of exposure to incoming fire.

SUMMARY OF THE INVENTION

The minimum exposure weapon consists of a pre-existing weapon upon which is retrofitted by replacing the rear stock and buffer tube with the improved stock and buffer tube. The improved stock is a collapsible stock and has the ability to pivot to the left or to the right. A front stabilizer is mounted to the forward hand guard and its purpose is to pivot out and make contact with the corner of a wall while allowing the barrel to protrude adjacent to the wall.

For example, to shoot from behind the left corner of a wall, the rear stock would be pivoted left and locked into position and the front stabilizer would be pivoted left and locked into position. A horizontal compact periscope would then be mounted from the left into a mount on the upper receiver and locked into position.

At this point, the shooter would use a conventional standing stance, gripping the rifle with his left hand on the forward handgrip, right hand on the trigger pistol grip, and pivoted stock butt against right shoulder. The shooter can lean his upper body weight against the stock and the weapon is effectively pinned between his shoulder and the wall. The weapon is supported and steadied. Mounted on the distal end of the front stabilizer is a shock absorber gripper, and as the weapon is fired the weapon recoils through the stock and into the shooter's right shoulder, but because the shooter is leaning into the stock, the amount of travel of the weapon is greatly reduced. The shock absorber gripper helps to prevent any hammering or excessive forces being applied to the weapon or to the shooter's right shoulder after the primary recoil. In other words, the shock absorber gripper cushions the contact between the gun and the wall, and also applies a friction point between the gun and the wall to stabilize and hold the weapon.

The horizontal compact periscope is used to allow the shooter to visually align the upper receiver mounted sight with the far sight mounted on the barrel during target acquisition while the shooter is hidden behind the wall.

The rear stock assembly is unique because it is not mounted to the buffer tube, but is mounted to a stock adaptor, which in turn is mounted to the lower receiver of the weapon. The stock assembly contains a stock extension, a rectangular bar, in which the stock interfaces. The stock extension contains a number of detents on which the slider pin can lock in; this gives the stock its collapsible function. The stock adaptor also contains a locking pin which, when released, allows the stock extension to rotate about the pivot pin which attaches it to the stock adaptor. The same locking pin will interface with the detent holes in the stock extension which locks the pivot position of the stock assembly to either neutral, left or to the right.

The front stabilizer is mounted to the bottom picatinny style rail on the forward hand guard utilizing the front stabilizer mount. The mount contains a locking pin which will lock the front stabilizer in the neutral position or will, when unlocked, allow it to rotate to the left or to the right.

The horizontal compact periscope has picatinny styled accessory mounts which allow it to be mounted bilaterally (left or right) into the upper receiver transverse sighting mount. The transverse sighting mount contains a locking pin to lock the horizontal compact periscope in position.

It is an object of the present invention to provide a weapon which can be carried and used as a conventional weapon and when necessary this weapon can be rapidly converted real time to support firing from behind a comer of a building or object.

It is a further object of the invention to provide a sighting system which is strictly passive in nature (requiring no electronics or power sources, i.e., rechargeable batteries) in order to assure the reliability of a system which may be exposed to various environments and extreme variation of combat conditions over prolonged periods of time that the user may be in the field.

DETAILED DESCRIPTION OF THE PREFERRED EMBODIMENTS

Figure 1:
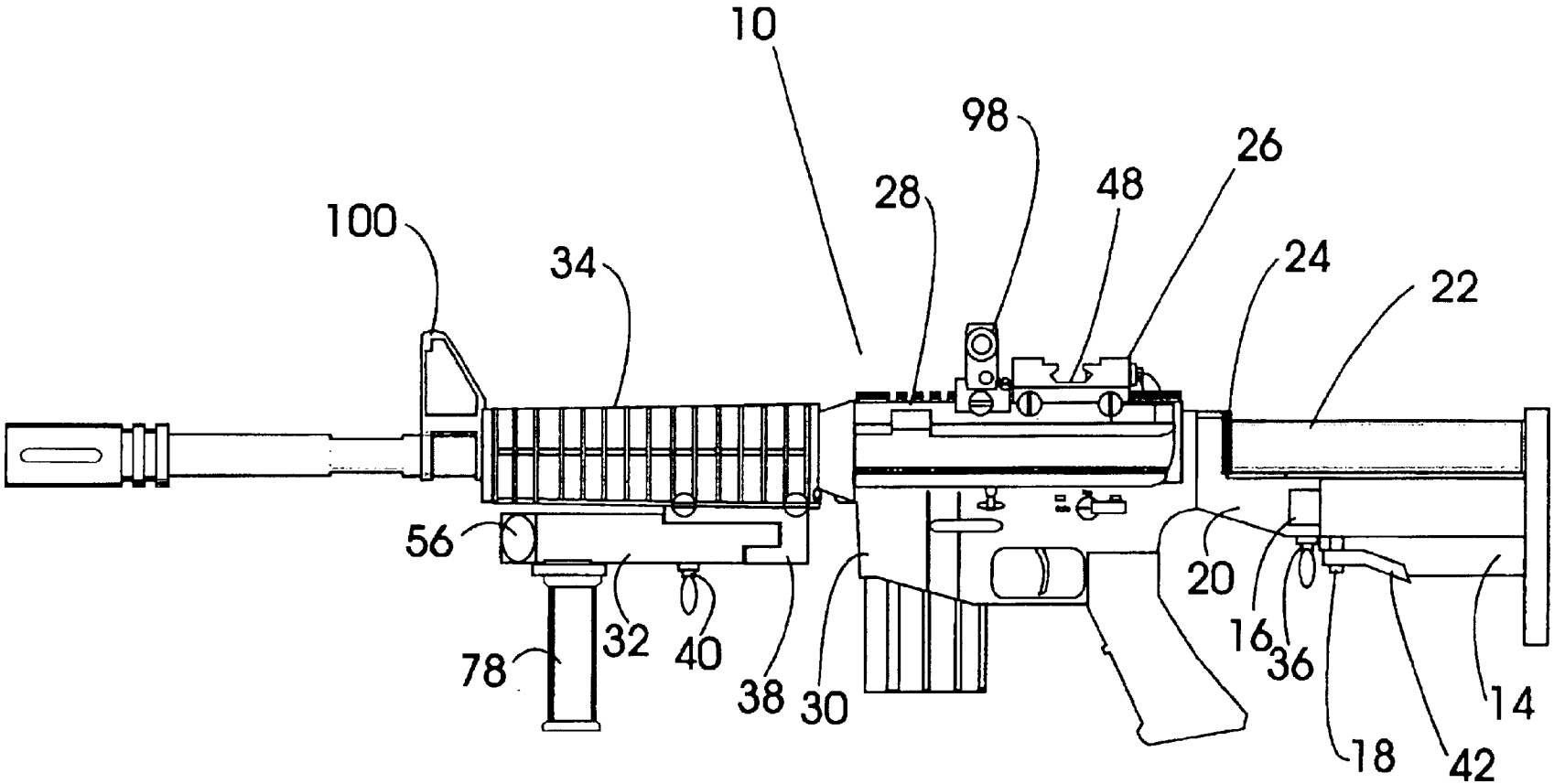
FIG. 1 is a left side elevated view of a typical tactical weapon embodying the present invention with the weapon in the conventional mode.

Turning now to the drawings, the minimum exposure weapon embodying the present invention is indicated generally by the reference numeral 10 in FIG. 1. This zero exposure weapon 10 is in the conventional mode in FIG. 1. In the conventional mode, the stock 14 is in the collapsed position on stock extension 16 and is captured in this position by the lock pin 18. the stock extension 16 is in line with respect to the stock adaptor 20 and locked in place with the lock pin 36. The stock adaptor 20 is mounted to the lower receiver 30, utilizing the additional threaded area on the buffer tube 22 and the locking nut 24. The transverse sight mount 26 is mounted to picatinny rail on the upper receiver 28.

Further examination of FIG. 1 shows that the front stabilization assembly 32 is attached to a picatinny accessory mount on the forward hand guard 34, utilizing the front stabilization mount 38. In the conventional mode, the front stabilizer assembly 32 is in line with the weapon 10 and is locked in position with the lock pin 40.

The minimum exposure weapon is comprised of an existing weapon with its stock and buffer tube removed. The buffer tube is replaced with a buffer tube 22 which has been manufactured with an additional length of threads which will act as a bolt, and with the accompanying locknut 24 the stock 14, stock extension 16 and stock adaptor 20 are mounted to the receiver. The front stabilization group (38, 40, and 32) is attached to the front hand guard. Finally, the transverse sight mount 26 is connected to the upper receiver 28.

Figure 2:
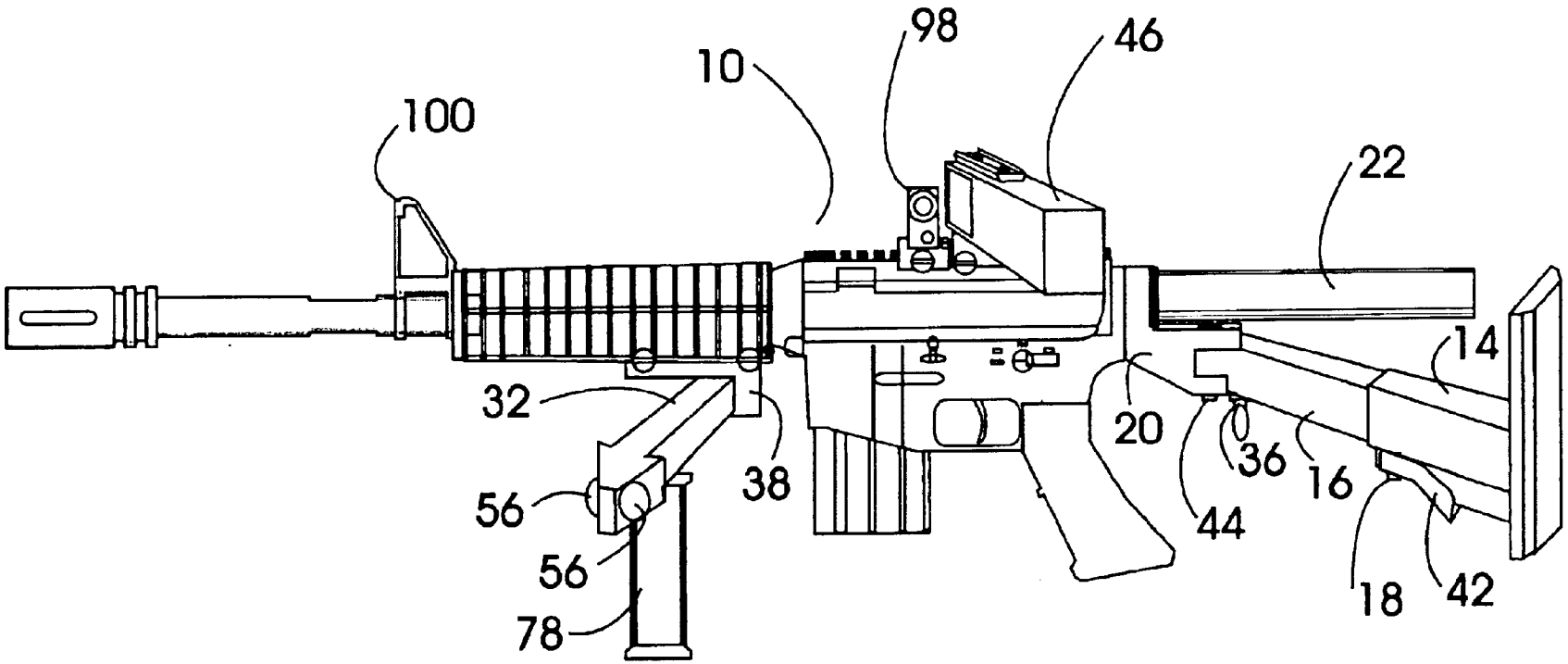
FIG. 2 is a left side elevated view of the weapon in the minimum exposure weapon mode.
Figure 18:
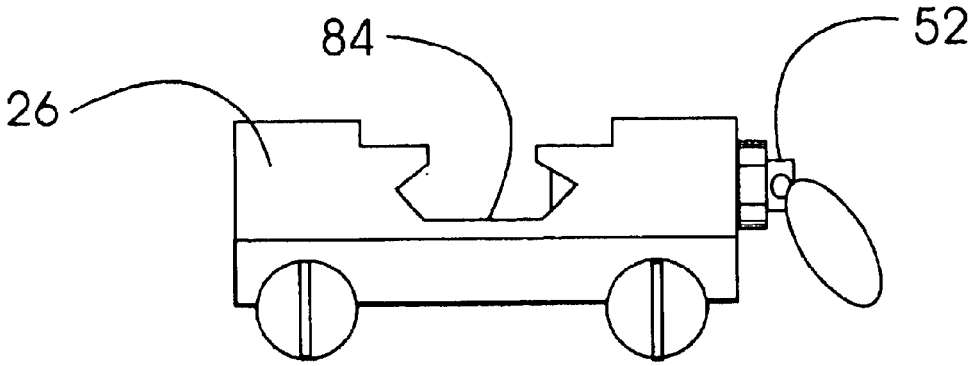
FIG. 18 is a left side view of the transverse sight mount.
Figure 21:
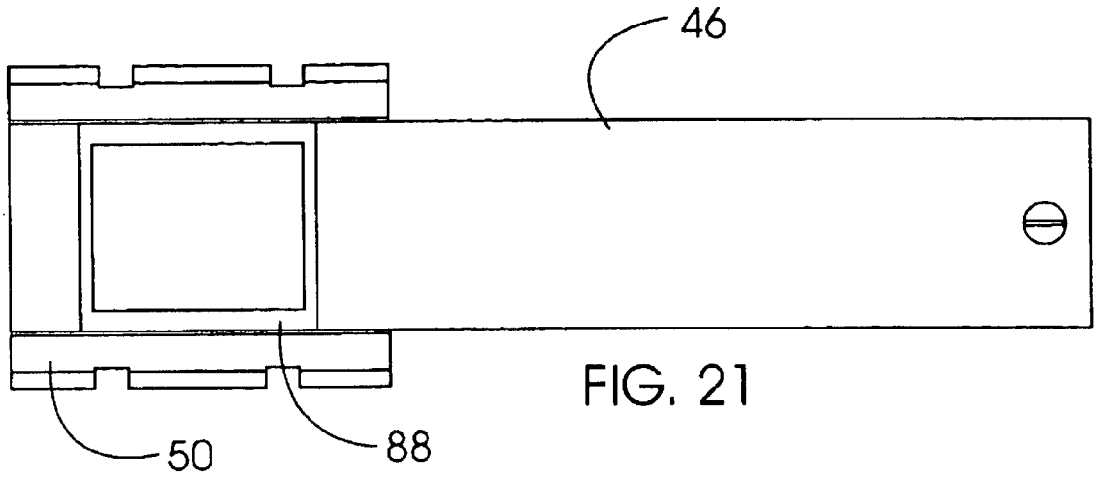
FIG. 21 is an anterior to posterior view of the horizontal compact periscope.

Reference FIG. 2. When the shooter determines he needs cover or protection from possible enemy fire, the zero exposure weapon 10 in Fig.2 is converted to the minimum exposure mode. The stock 14 has been extended to the rear on the stock extension 16 by depressing the locking pin 18 release lever 42 and extending the stock 14. The pivot locking pin 36 releases the stock extension 16 and allows the stock extension 16 to rotate around pivot pin 44, where locking pin 36 locks stock extension 16 at the required angle. User-carried horizontal compact periscope 46 is installed in the rail mount slot 48 (FIG. 1) of transverse sight mount 26 (FIG. 1), using the bottom accessory rail 50 (FIG. 21) on the horizontal compact periscope 46, and is locked in place by the transverse sight mount locking pin 52 (FIG. 18). The front stabilizer assembly is rotated about the pivot pin 54 (FIG. 11) in the front stabilizer mount 38. The locking pin 40 (FIG. 1) uses detent 58 (FIG. 11) and when released from detent 58 (FIG. 11), the front stabilizer assembly 32 can rotate bilaterally. Two shock absorber grippers 56 are mounted to the distal end of the front stabilizer assembly 32. the shock absorber grippers 56 provide for shock reduction during recoiling. When the user is in position behind a wall, he leans into the weapon and the shock absorber grippers 56 make contact with the wall. During the recoil process, the weapon is pinned between the shooter and the wall. The force is initially transmitted to the shooter, but because the shooter is leaning into the weapon stock 14, some of the force is transmitted through the weapon 10 via the front stabilization assemble 32 and the shock absorber gripper assembly 56 into the wall. Basically, the shock absorber gripper assembly 56 will absorb some of the shock or jarring which would cause excessive wear to the weapon and excessive jarring to the shooter.

Figure 3A:
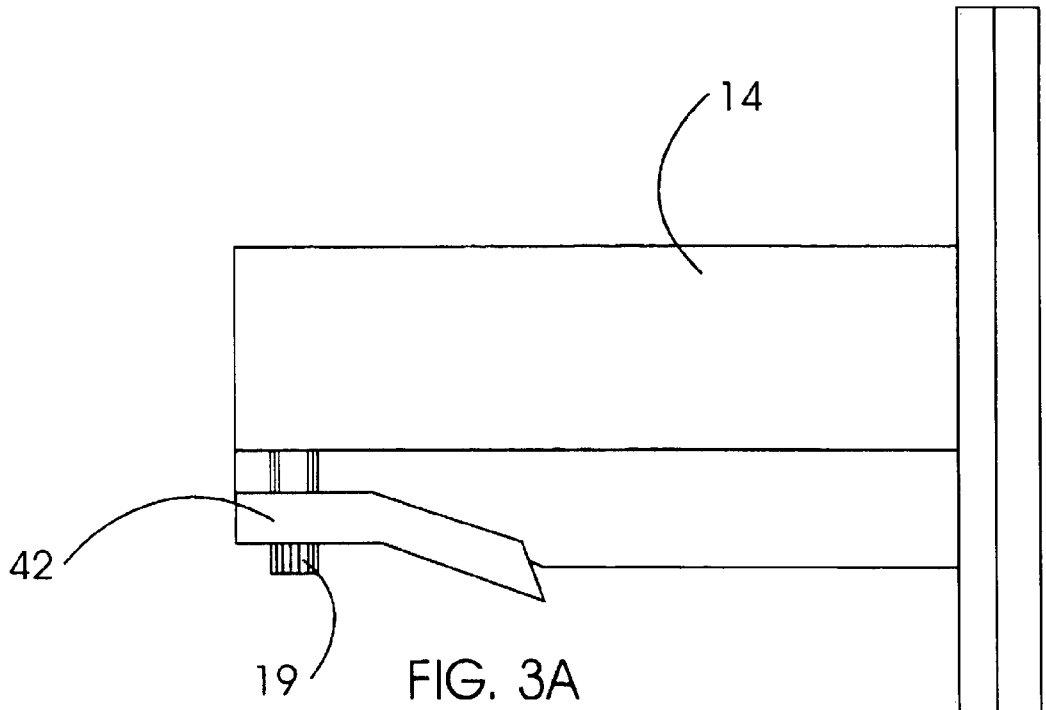
FIG. 3A is a left side view of the rear stock.
Figure 3B:
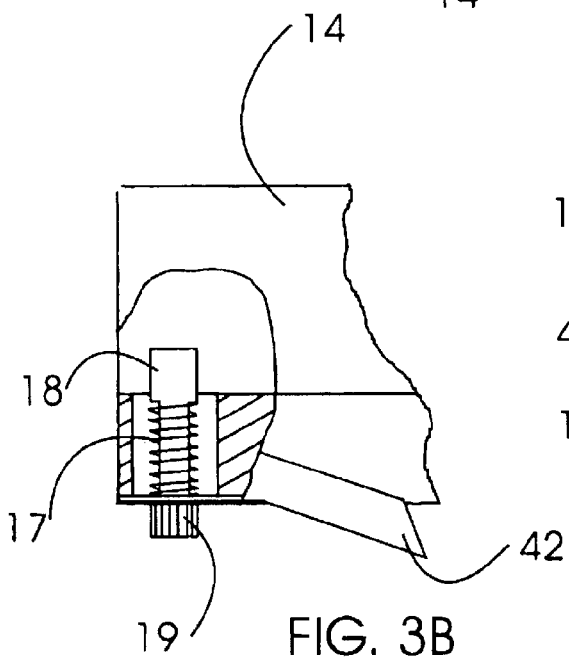
FIG. 3B is a detailed view of the slider locking pin assembly.
Figure 4:
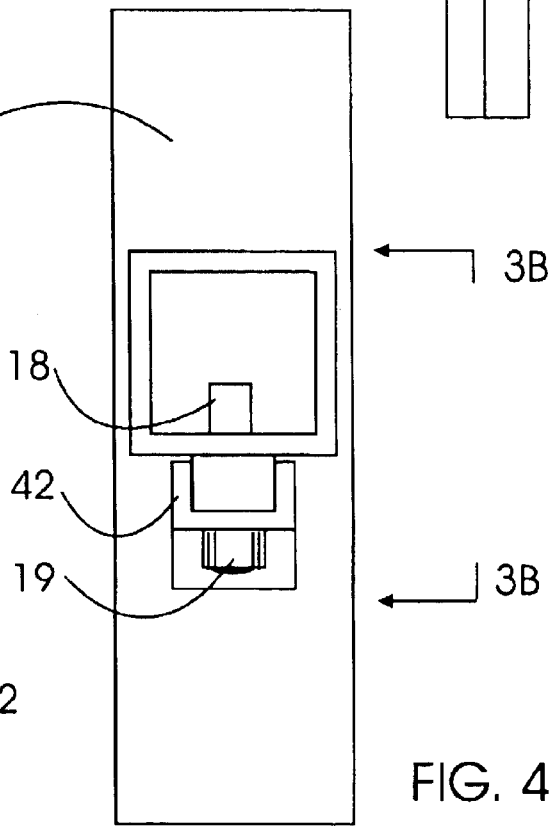
FIG. 4 is an anterior to posterior end view of the rear stock.

FIGS. 3A, 3B and 4 detail the rear stock 14. Locking pin 18 is secured in stock housing by the locking pin nut 19. Spring 17 provides the means to hold locking pin 18 into one of the detents 60 (FIG. 6) on the stock extension 16 (FIG. 2). Lever 42 releases locking pin 18 from one of the detent 60 (FIG. 6) to reposition the rear stock 14.

Figure 5:
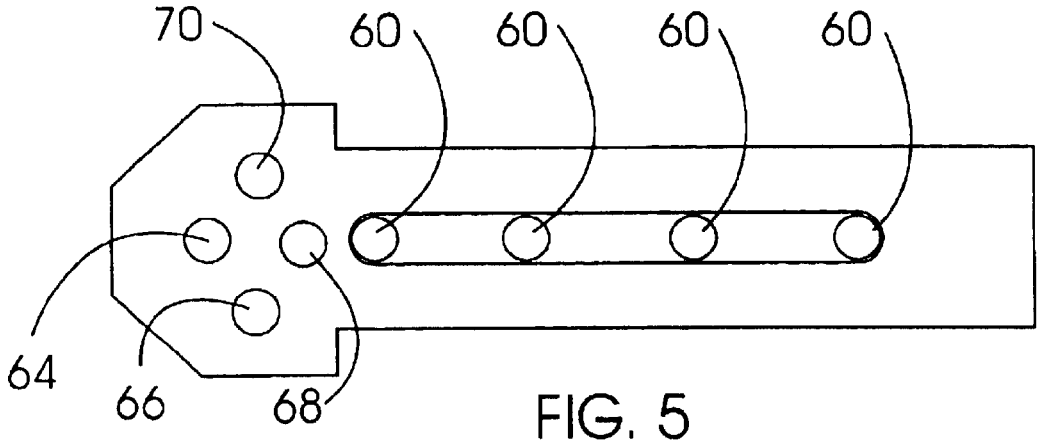
FIG. 5 is the bottom view of the stock extension.
Figure 6:
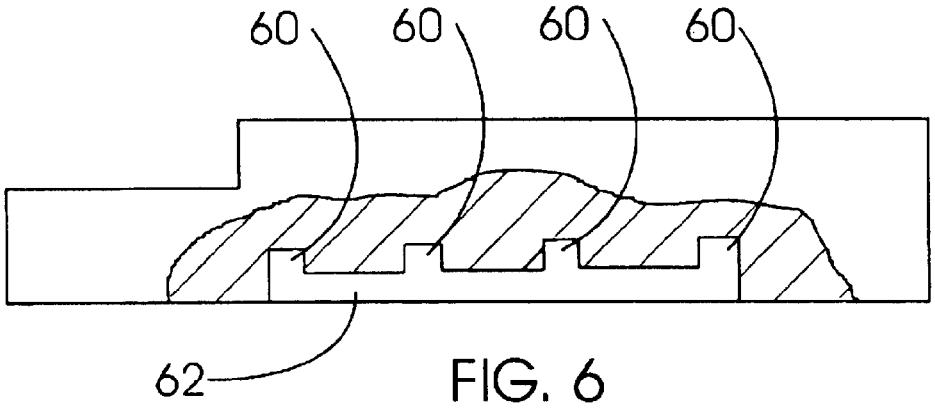
FIG. 6 is a left side view of the stock extension.
Figure 7:
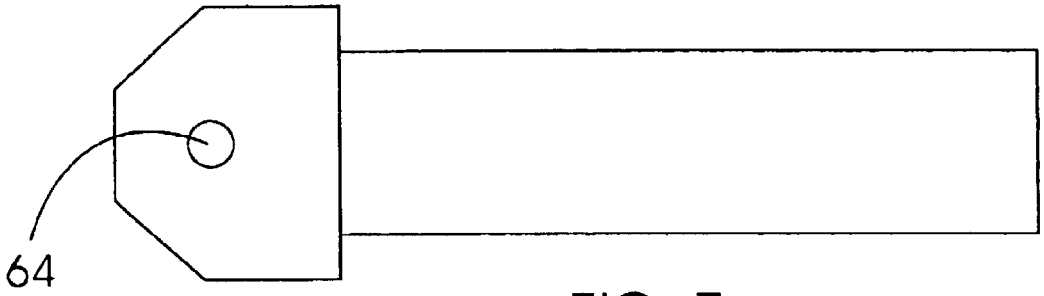
FIG. 7 is a top view of the stock extension.

FIGS. 5, 6 and 7 detail the stock extension 16. The plurality of detents 60 are located to specific location for locking and positioning of the collapsible stock 14 (FIG. 3A) into the desired position, utilizing locking pin 18 (FIG. 3). Track 62, in conjunction with locking pin 18 (FIG. 3B), maintains stock 14 (FIG. 3) on receiver extension 16 (FIG. 1). Orifice 64 is penetrated by pivot pin 44 (FIG. 2) to allow rotation or pivoting of the entire stock assembly. Locking pin 36 (FIG. 2) will reside and lock in one of three detents, 70, 68 or 66, depending upon whether the stock assembly is locked to the right, centered, or to the left, respectively.

Figure 8:
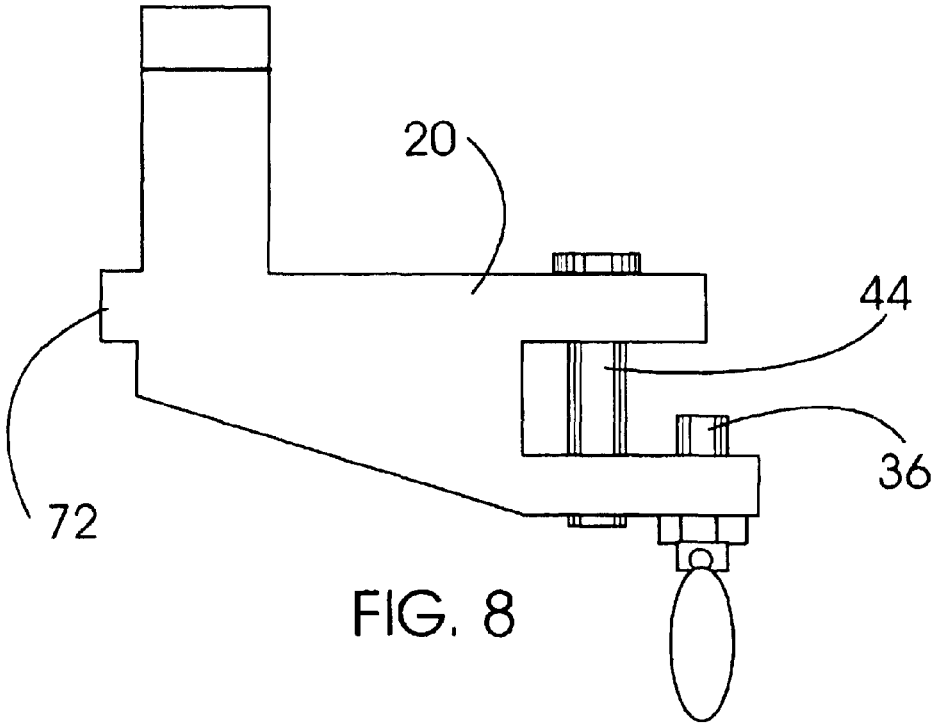
FIG. 8 is a left side view of the stock adaptor.
Figure 9:
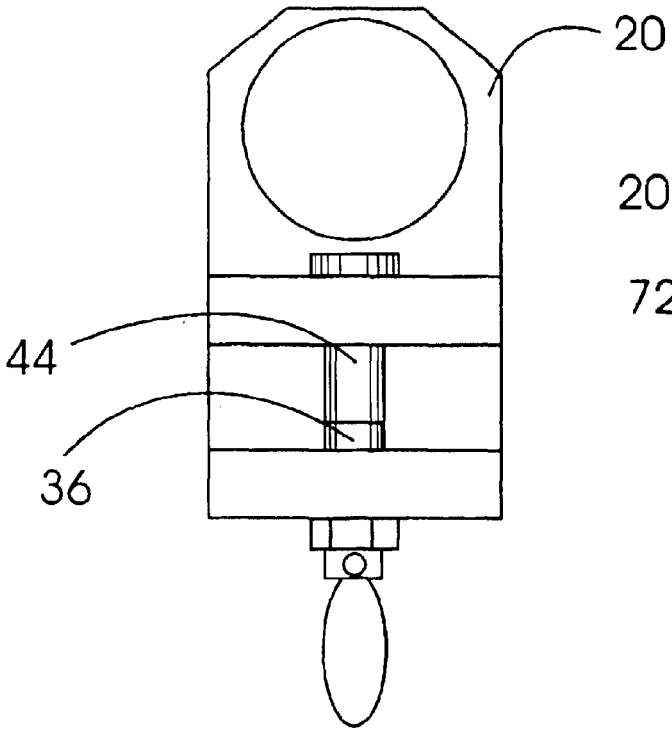
FIG. 9 is a posterior to anterior view of the stock adaptor.
Figure 10:
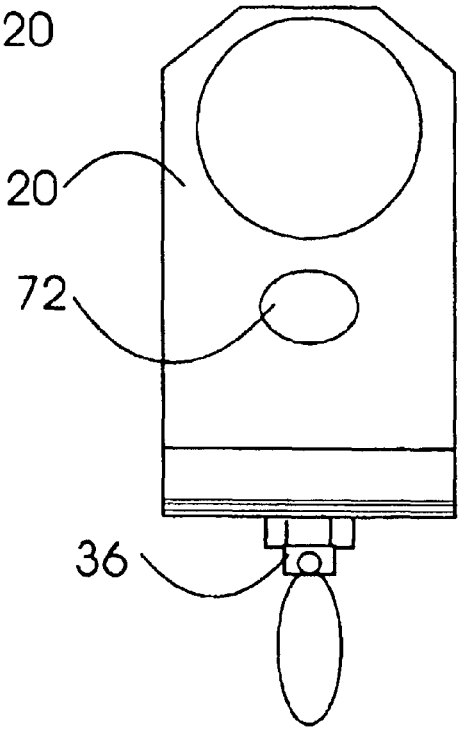
FIG. 10 is an anterior to posterior view of the stock adaptor (the lower receiver mating surface).

FIGS. 8, 9, and 10 detail the previously discussed stock adaptor 20 (FIG. 1). The feature not previously discussed is the oval protrusion 72 which penetrates an orifice contained on the lower receiver to maintain correct orientation of the stock adaptor 20, thus the entire stock assembly.

Figure 11:
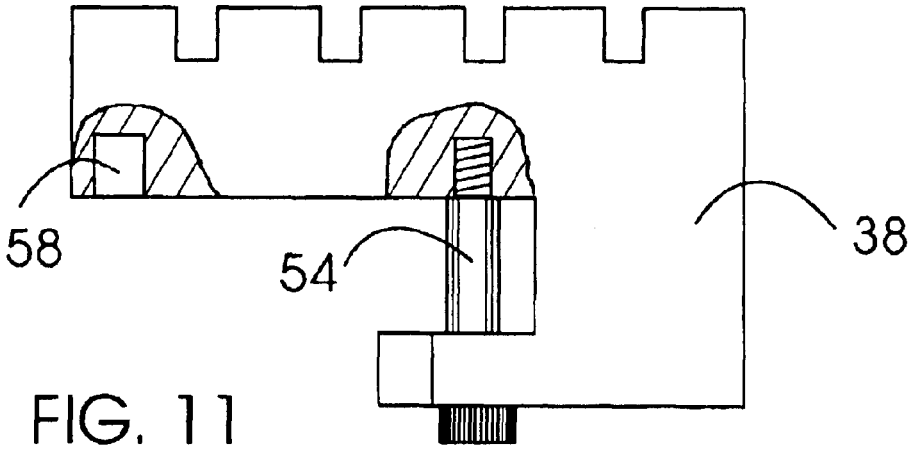
FIG. 11 is a left side view of the front stabilizer mount.
Figure 12:
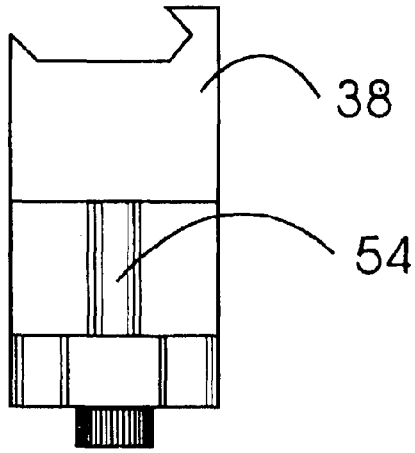
FIG. 12 is an anterior to posterior view of the front stabilizer mount.
Figure 13:
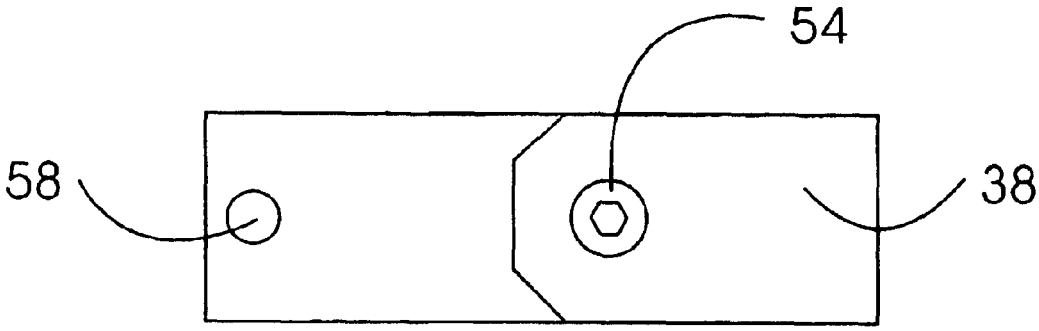
FIG. 13 is a bottom view of the front stabilizer mount.
Figure 14:
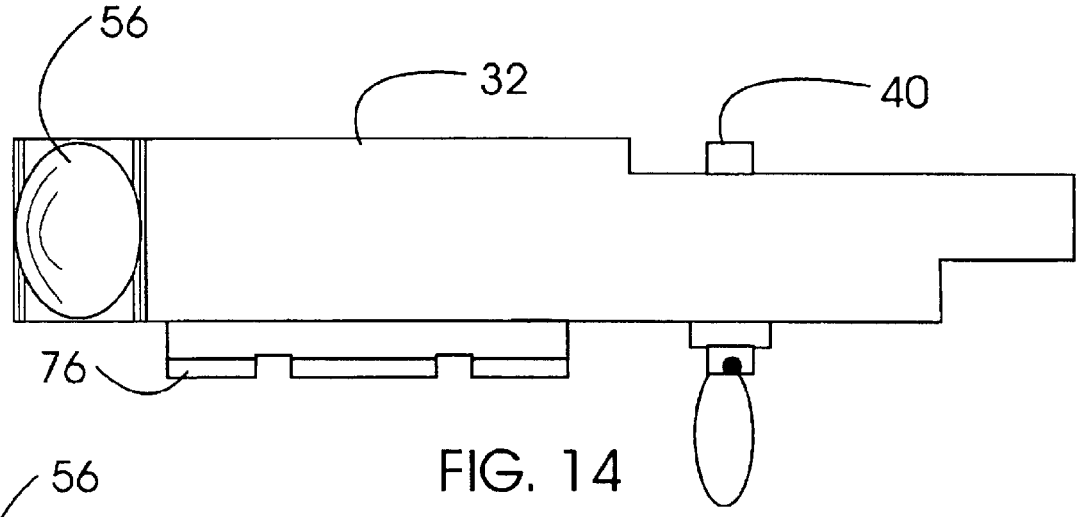
FIG. 14 is a left side view of the front stabilizer assembly.
Figure 15:
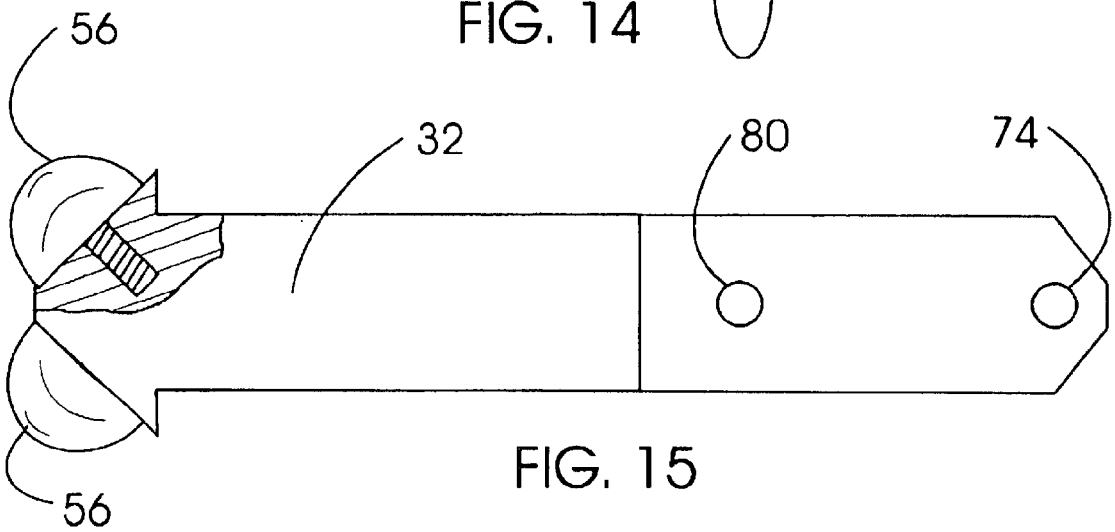
FIG. 15 is the top view of the front stabilizer assembly.
Figure 16:
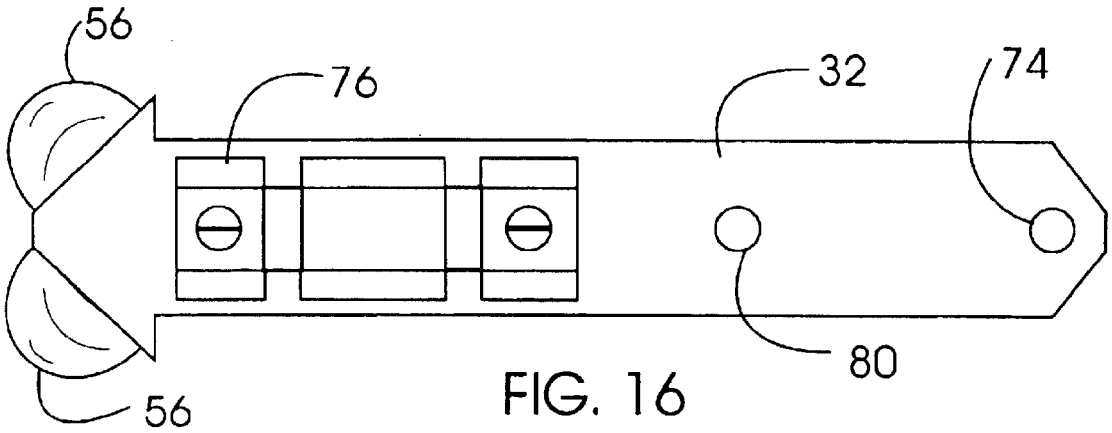
FIG. 16 is the bottom view of the front stabilizer assembly.

FIGS. 11, 12 and 13 detail the front stabilizer mount pivot bolt 54, allowing pivoting of the front stabilizer assembly 32 (FIGS. 14, 15 and 16) through hole 74 (FIGS. 15 and 16). Detent 58 (FIG. 11) interfaces with locking pin 40 (FIG.14) to either allow the front stabilizer 32 to rotate to the right or to the left, or to be locked in the center or neutral position.

FIGS. 14, 15 and 16 further detail the front stabilizer assembly 32, has a bottom mounted rail 76 in which a handgrip 78 (FIG. 1) is mounted. FIG. 15 details the shock absorber gripper 56, which is screwed into the distal end of the front stabilizer assembly 32. A threaded hole 80 houses the locking pin 40.

Figure 17A:
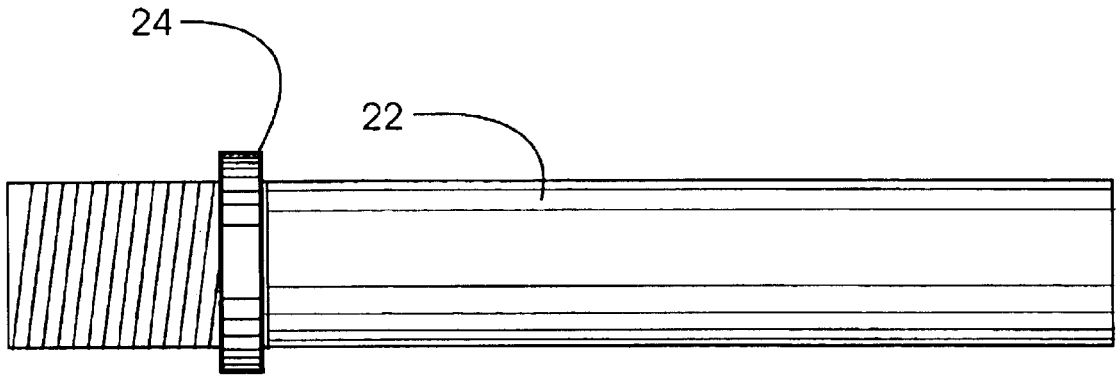
FIG. 17A is the left side view of the buffer tube.
Figure 17B:
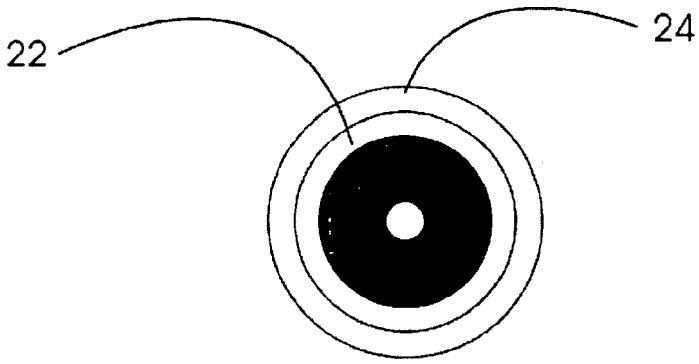
FIG. 17B is an end view of the buffer tube.

FIGS. 17A and 17B detail the improved buffer tube and locking nut.

Figure 19:
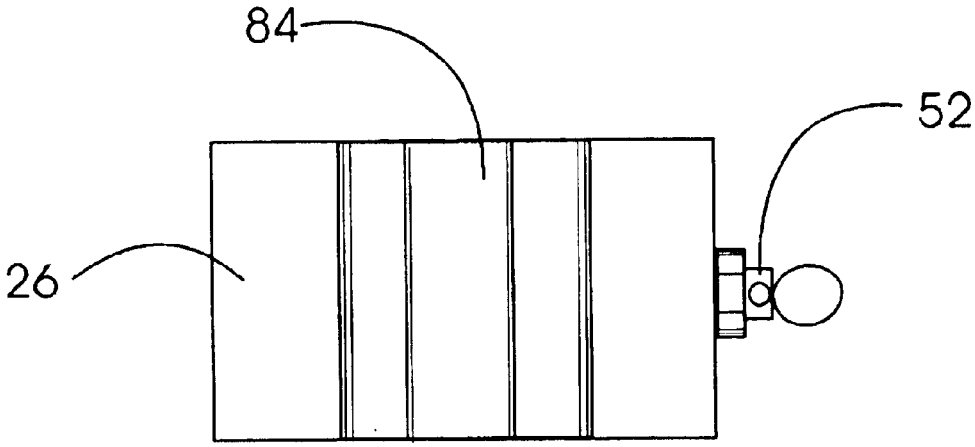
FIG. 19 is a top view of the transverse sight mount.
Figure 20:
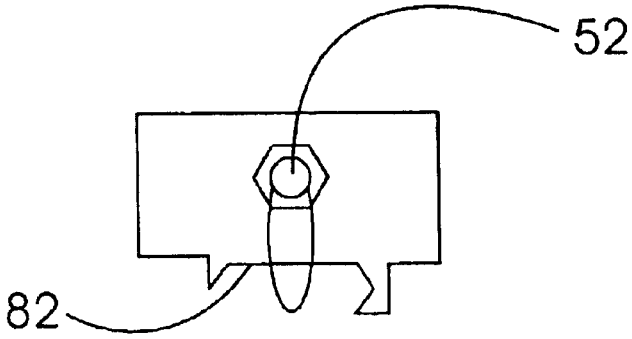
FIG. 20 is a posterior to anterior view of the transverse sight mount.
Figure 22:
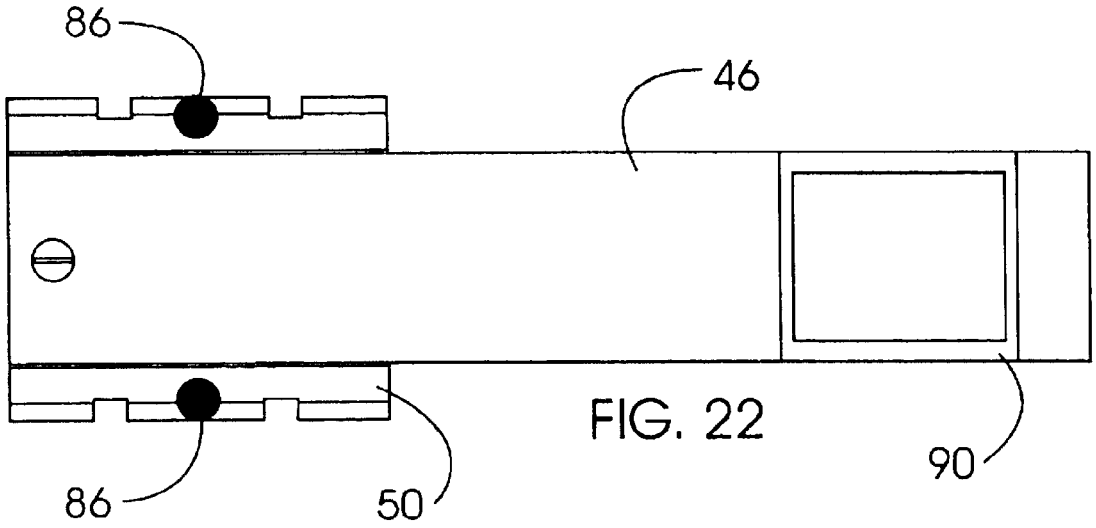
FIG. 22 is a posterior to anterior view of the horizontal compact periscope.
Figure 23:
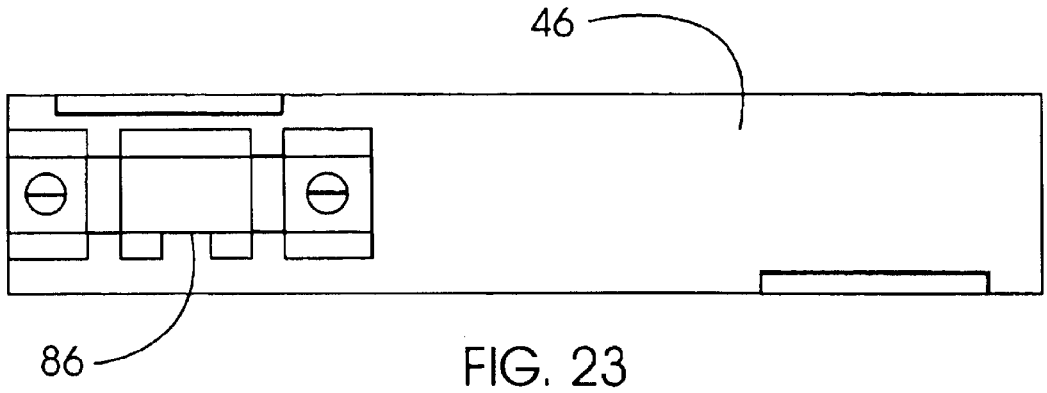
FIG. 23 is a top view of the horizontal compact periscope.

FIGS. 18, 19, and 20 detail the transverse site mount which is mounted to the upper receiver picatinny rail by the bottom rail receptacle 82. The upper rail receptacle 84 accepts the horizontal compact periscope 46 (FIG. 2) accessory mount 50 (FIGS. 21, 22) and locking pin 52 interfaces with detent 86 (FIGS. 22 and 23) and the horizontal compact periscope 46.

Figure 24:
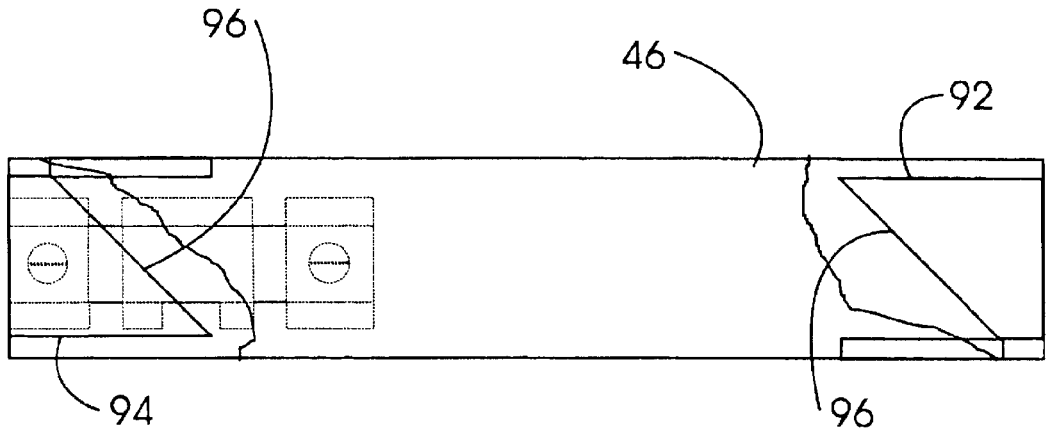
FIG. 24 is a top view of the horizontal compact periscope with cut-away sections showing mirror mounts.

FIGS. 21, 22, 23, and 24 detail the horizontal compact periscope 46. the basic construction consists of two windows, 88 and 90 (FIGS. 21 and 22), two mirror mounts, 92 and 94, (FIG. 24) seen on the cut-away view of FIG. 24, attached with 2 mirrors 96 (FIG. 24). The detent 86 (FIG. 22), in conjunction with the transverse sight mount 26 lock pin 52 (FIG. 18), properly aligns the horizontal compact periscope. Basically, the periscope will allow the operator to sight the rifle from the upper receiver sight 98 (FIG. 2) to the far sight. the advantage of this system allows for the user to remove and install the horizontal compact periscope without disturbing the alignment of the rifle 10 based sighting system.

Figure 25:
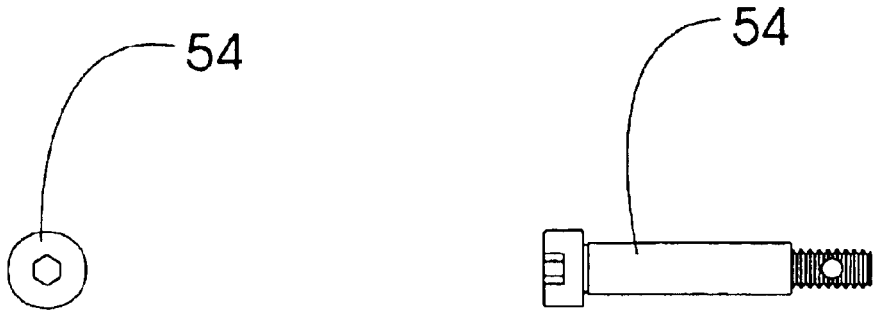
FIG. 25 is a side and end view of the front stabilizer pivot bolt.
Figure 26:
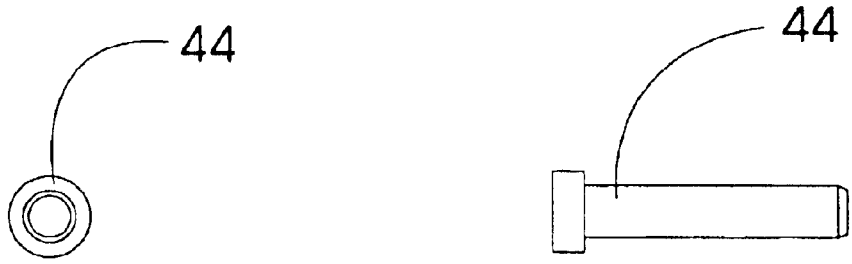
FIG. 26 is a side and end view of the stock adaptor pivot pin.
Figure 27:
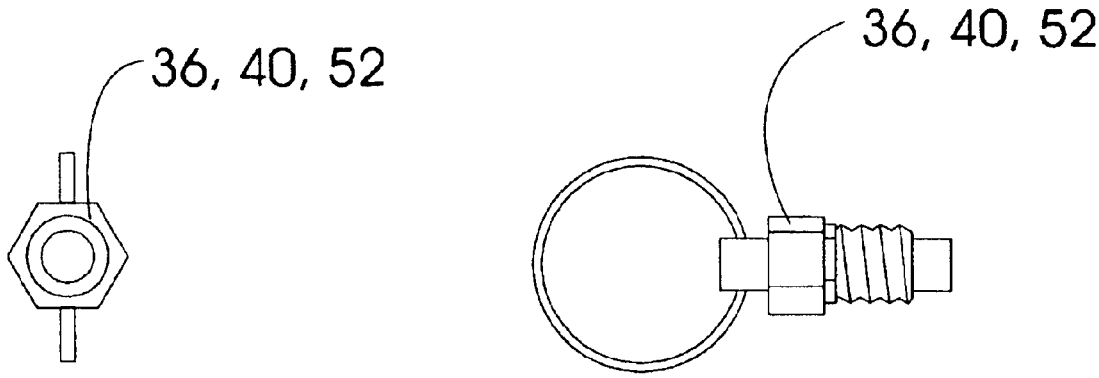
FIG. 27 is a side and end view of the locking pin assembly used in the stock adaptor, the transverse sight mount, and the front stabilizer assembly.

FIG. 25 details the pivot bolt 54 which is mounted in the front stabilizer mount (FIG. 11). FIG. 25 details the pivot pin 44 which is mounted in the stock adaptor 20 (FIG. 8). FIG. 27 details the locking pins 36, 40 and 52 which are used in the stock adaptor 20 (FIG. 8), the front stabilizer 32 (FIG. 14), and the transverse sighting mount 26 (FIG. 18).

I claim:

1. A minimum exposure weapon comprising:

(a) a weapon having a receiver, a buffer tube, a barrel projecting from the receiver, firing mechanisms and at least one sight mounted with respect to said barrel to establish a sighting line adjacent and substantially parallel to said barrel;

(b) a stock assembly adapter supporting a stock assembly having a rear stock selectively positional along the length of a stock extension, said stock extension also selectively positional in regards to bilateral rotation to support the positioning of said minimum exposure weapon to fire from behind a wall, said stock assembly adapter removably mounted to said buffer tube;

(c) a front stabilizer mounted to a forward hand guard to contact and maintain contact between said minimum exposure weapon and said wall prior, during, and proceeding weapon discharging; and (d) a horizontal compact periscope utilized to align the at least one sight to provide for target acquisition.

2. The minimum exposure weapon, as set forth in claim 1, further comprises the stock assembly adaptor containing both a pivoting pin and a locking pin allowing said stock assembly to be capable of bilateral rotation and secured in desired position, said stock assembly adaptor is mounted adjacent said receiver by utilizing buffer tube and locking nut, wherein an oval projection from said stock adaptor mates with a detent in said receiver, thus establishing and maintaining the proper orientation between said stock assembly and said receiver.

3. The minimum exposure weapon recited in claim 2, further comprising said stock extension having a plurality of detent holes formed therein; and means for securing the rear stock to a desired position on said stock extension.

4. The minimum exposure weapon as claimed in claim 3, is further comprised of said stock extension which is rectangular in shape as is also the mating receptacle of said rear stock, whereby in this combination results the means that proper attitude is established and maintained between said stock extension and said rear stock.

5. The minimum exposure weapon, as claimed in claim 4, is further comprised of said rear stock containing a slider pin and said rear stock contains a spring as the means for holding said slider pin in one of said plurality of detents in said stock extension.

6. The minimum exposure weapon, as claimed in claim 5, whereby said rear stock utilizes a lever operably engaged with said slider, releasing said slider pin from said detent in said stock extension so that when said slider pin is released, said rear stock may be moved to a different position along said stock extension.

7. The minimum exposure weapon, as claimed in claim 1, where said front stabilizer comprises a front stabilizer mount in which a military-style picatinny rail is utilized in order to attach the front stabilizer mount to the said forward hand guard.

8. The minimum exposure weapon as claimed in claim 7 further comprises said front stabilizer mount which is further comprised of a pivot pin and a locking pin whereby the said front stabilizer is locked into the neutral position in line with said barrel of said minimum exposure weapon by said locking pin which mates with a detent hole in said front stabilizer mount and, when required, is released by said locking pin, whereby said front stabilizer is allowed to rotate bilaterally, either to the right or to the left around said front stabilizer mount pivot pin.

9. The minimum exposure weapon claimed in claim 8 further comprises shock absorbing grippers screw mounted to the distal end of said front stabilizer whereas said shock absorbing grippers contact said wall or surface during target acquisition when said operator places force against said rear stock.

10. The minimum exposure weapon claimed in claim 1 is also comprised of a transverse sighting mount which provides a means for quickly attaching and releasing said horizontal compact periscope or other optical sighting systems to the receiver of said minimum exposure Weapon.

11. The minimum exposure weapon claimed in claim 1, wherein said horizontal compact periscope is mounted into a transverse sight mount, utilizing military styled rails attached to the top and to the bottom surface of said horizontal compact periscope, said horizontal compact periscope is secured into position by mating a quick release locking pin of said transverse sight mount to a detent hole in said military style rail in said horizontal compact periscope.

12. The minimum exposure system claimed in claim 1, wherein said horizontal compact periscope is mounted to said receiver enables visual alignment of the at least one sight during target acquisition.

13. The minimum exposure weapon claimed in claim 12, wherein said horizontal compact periscope comprises a rectangular tube body having a mirror adjacent an inlet aperture to direct the shooter's view substantially horizontally through said rectangular tube to a mirror positioned by an outlet aperture where the shooter can directly see the sighting line to the target.

14. The minimum exposure weapon claimed in claim 13 wherein said horizontal compact periscope mounted either utilizing the said top military style rail or mounted utilizing the said bottom military style rail to support bilateral visual sighting support for shooting from behind a left or right corner wall or object.

15. The minimum exposure weapon claimed in claim 2, wherein said buffer tube and locking nut, attaches said stock adaptor to said receiver by means of threads on the buffer tube, sufficient to transverse the stock adaptor assembly and fully thread into the receiver.

16. The minimum exposure weapon claimed in claim 15, wherein said buffer tube is cylindrical in shape and is of such length, to transverse said stock adapter assembly and to house a buffer weight and recoil spring.

17. The minimum exposure weapon claimed in claim 7 further comprises a military styled rail mount affixed to the bottom surface of said front stabilizer and a handgrip mounted to said military styled rail.

* * * * *